United States Patent [19]

Tickle

[11] 4,211,408

[45] Jul. 8, 1980

[54] FIGURE UNIT FOR SPORTS GAMES

[75] Inventor: Roy P. Tickle, Tunbridge Wells, England

[73] Assignee: Subbuteo Sports Games Limited, United Kingdom

[21] Appl. No.: 23,258

[22] Filed: Mar. 23, 1979

Related U.S. Application Data

[63] Continuation of Ser. No. 826,313, Aug. 22, 1977, abandoned.

[51] Int. Cl.[2] ..... A63H 15/06

[52] U.S. Cl. ..... 273/85 R; 46/155

[58] Field of Search ..... 273/85 R, 85 B, 85 F, 273/129 B, 128 R; 46/155, 32

[56] References Cited

U.S. PATENT DOCUMENTS

| | | | |
|---|---|---|---|
| 2,107,672 | 2/1938 | Lang | 46/155 |
| 3,945,640 | 3/1976 | Denmark | 273/85 R |
| 3,997,164 | 12/1976 | White | 273/128 R |
| 4,129,963 | 12/1978 | Perry | 46/155 |

FOREIGN PATENT DOCUMENTS

| | | | |
|---|---|---|---|
| 139020 | 10/1950 | Australia | 273/85 R |
| 2356194 | 5/1974 | Fed. Rep. of Germany | 273/85 R |
| 638860 | 6/1950 | United Kingdom | 273/85 R |
| 1334133 | 10/1973 | United Kingdom | 273/85 R |

*Primary Examiner*—Richard C. Pinkham
*Assistant Examiner*—R. Carl Moy
*Attorney, Agent, or Firm*—Wolf, Greenfield & Sacks

[57] ABSTRACT

A figure unit for a game has a figure disposed on a disc that is secured to a self-righting cup. The disc is connected to the cup by a connection that is concealed within the cup. For that purpose, the disc is provided with a spigot that protrudes down into the cup and engages a socket inside the cup. Preferably the socket is a hollow cylinder that extends upwardly from the cup's bottom and preferably the socket is split longitudinally to form flexible segments that grip the spigot. In one embodiment, an annular metal ring is placed around the socket near the bottom of the cup to limit spreading of the segments when the spigot is engaged in the socket and to act as a ballast weight for righting the cup. To cause the segments to more firmly grip the spigot, a spring clip can be placed around the socket to make the segments clamp around the spigot. As an alternative to the spring clip, the disc can be provided with a downwardly depending sleeve that fits around the socket that keeps the segments tight against the spigot. The disc preferably then has a central part which carries the figure and the spigot on opposite sides and has a separate peripheral part which carries the sleeve.

4 Claims, 10 Drawing Figures

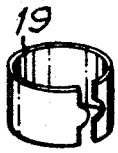
FIG. 7
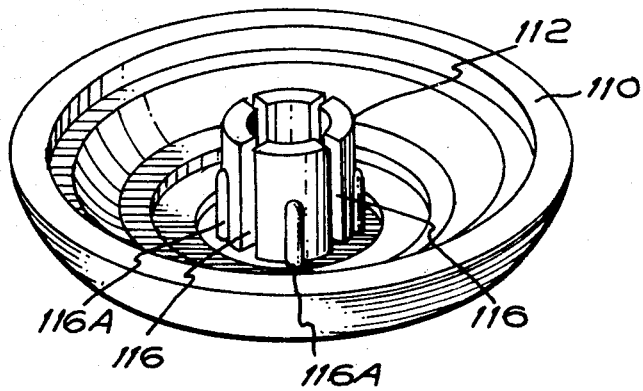
FIG. 8
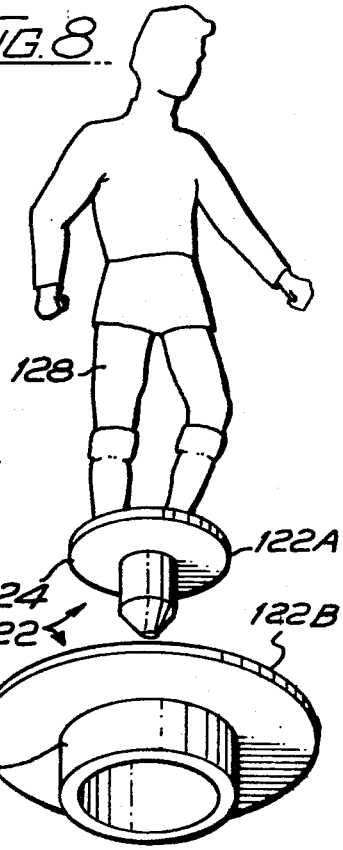
FIG. 9
FIG. 10
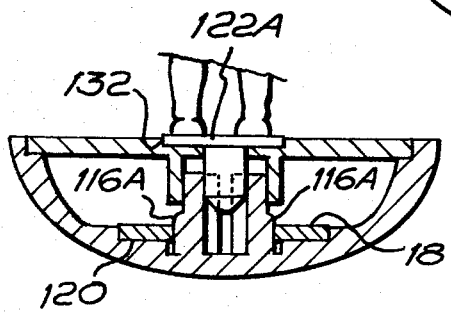

FIGURE UNIT FOR SPORTS GAMES

This application is a continuation of my earlier application Ser. No. 826,313, now abandoned, which was filed in the United States Patent Office on Aug. 22, 1977.

This invention relates to figure units for sports games comprising a figure on a mounting which is of the type which tends to keep the figure upright so that the unit will be "self-righting" in the event that the unit is tilted from the upright position. Such units may be for use in sports games such as football, hockey, cricket or rugby in which case the figure will be a representation of a human figure, but the invention also applies where the figure represents an inanimate object, such as a ball, wickets, and so on, and references to "figure" in this specification and in the appended claims are to be construed accordingly.

The mountings of such units have usually comprised a generally saucer shape hollow base cup which is closed by a disc, the disc carrying or being adapted to carry the figure. In such arrangement, it is usual furthermore to include in the base cup, a ballast weight which assists in keeping the unit upright.

There have been a number of proposals for connecting the disc to the base cup. Normally, the periphery of the disc simply is glued to the top of the base cup, but this suffers from a number of disadvantages. The glue and disc have to be applied manually, which is time consuming, and the use of glue can sometimes result in an unsightly finished article. One proposal for overcoming these difficulties is set out in our British Pat. No. 1,334,133 in which it is proposed that the disc and cup be designed for snap fitting together. This arrangement can give rise to problems as the manufacturing tolerances are small, and there is the danger of the parts coming apart when the units are subjected to certain temperature conditions, as a result of which could cause expansion or contraction of the parts to such an extent that they come apart.

Most of the assembly of these mountings is done by hand, and the known arrangements for connecting base cup and disc do not lend themselves to automating the assembly process.

The present invention seeks to provide a means for the connecting together of the disc means and base cup, which is free from the aforesaid disadvantages, and which, at least in a preferred form lends itself to automating the assembly of disc means and base cup.

In accordance with the present invention there is provided a figure unit for a sports game comprising a figure mounted on a self righting mounting, said mounting comprising a base cup, the top of which is closed by disc means on the top side of which the figure stands, characterised in that the disc means is connected to the base cup by means of a spigot and socket element connection, of which one element is at the bottom of the cap and the other element is at the side of the disc means remote from the figure.

Preferably, the disc means is in two parts, namely a center part and a peripheral part, the central part having said figure on one side and the spigot element on the other side, the socket element being at the base of the cup.

The socket element may extend upwards from the base and the peripheral part of the disc means may be provided with a holding sleeve which fits round the socket element when the disc means closes the base cup. In an alternative arrangement, there may be a spring sleeve for fitting round the socket element.

In a modified arrangement, the disc means is in one piece with the figure on one side and the spigot element on the other side.

Although it is preferred that the disc means be circular and the base cup be of circular section, other configurations are possible within the scope of the present invention. The disc means and base cup preferably are of plastics material, and conveniently there may also be a ballast weight for the mounting.

The socket element is preferably a bushing formed integrally with the base cup and is axially split to define segments which can by the holding sleeve or tensioning means, be prevented from distorting excessively outwards. The ballast weight may suitably be a metal washer of appropriate size to be pushed over the bushing. The spigot element and socket element may be held together by the frictional interfit therebetween and/or by means of adhesive positioned in the socket element.

Embodiments of the present invention will now be described, by way of example, with reference to the accompanying drawing, wherein:

FIG. 7 is a perspective view of the spring clip forming tensioning means of the mounting in each of the arrangements shown in FIGS. 4 and 6;

FIG. 8 is a perspective view of a base cup of a mounting according to another embodiment of the present invention;

FIG. 9 is a perspective view of a disc means and a figure integral with a part of said disc means, usable with the base cup of FIG. 8; and FIG. 10 is a sectional elevation showing the base cup of FIG. 8, the washer of FIG. 2, and the disc means of FIG. 9 in assembled condition.

Figure 1:
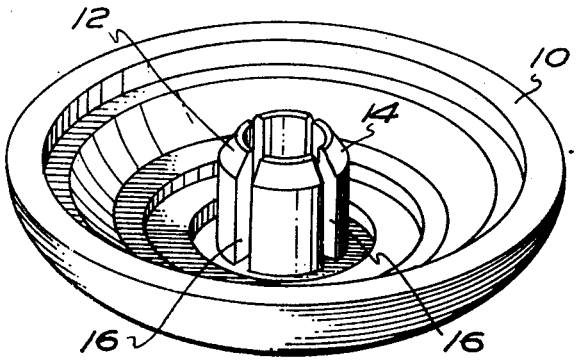
FIG. 1 is a perspective view of a base cup of a mounting according to the present invention.

Referring to the drawings, and first to FIG. 1, in this drawing there is shown a base cup for a mounting of a figure unit of the type to which the invention relates. The base cup is moulded in plastics material in the configuration shown, which is of circular cross-section, and in the center of the cup, which is referenced 10 in the drawing, there is provided a socket element 12 of a spigot and socket element connection which socket element extends upwardly from the central bottom region of the cup. The socket element is a bushing of generally cylindrical form and has a chamfered top edge 14. The socket element is provided with axial slots 16 at 90° spaced locations so as to leave four socket element segments which can be distorted radially inwards or outwards together so as to narrow or enlarge the bore of the socket, at least at the top end thereof.

Figure 2:
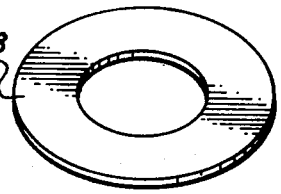
FIG. 2 is a perspective view of a washer usable with the base cup of FIG. 1.

In FIG. 2 there is shown a washer 18 which serves as a ballast weight for the base cup, and indeed the entire mounting, as will be explained. In order to prevent distortion of the socket element segments outwardly after locating the washer 18 on the chamfered top edge 14, and pushing the washer 18 downwardly until it reaches the seating ledge 20 (FIG. 4) in the bottom of the base cup 10, the spring clip 19, which is a split, spring metal sleeve, is pushed over the socket element 12 until it reaches the position shown in FIG. 4 in which it is wrapped round the outside of socket element 12 and bears on washer 18 keeping it in position.

Figure 3:
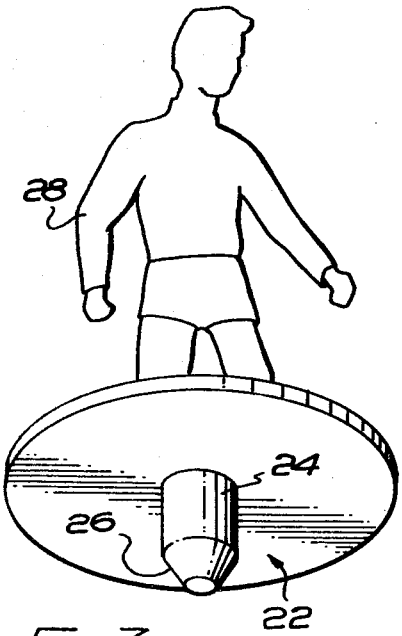
FIG. 3 is a perspective view of a disc means and integral figure usable with the base cup of FIG. 1.

In order to complete the assembly the cup 10 is closed by the disc means 22 shown in FIG. 3. On the bottom side, and in the central region thereof, the disc means 22 is provided with the spigot element 24 of the spigot and socket element connection. Spigot element 24 is of cylindrical form, and has a chamfered end 26. On the top side, the disc means 22 is provided integrally with a figure 28, in this case a figure representing a model of a football player.

Figure 4:
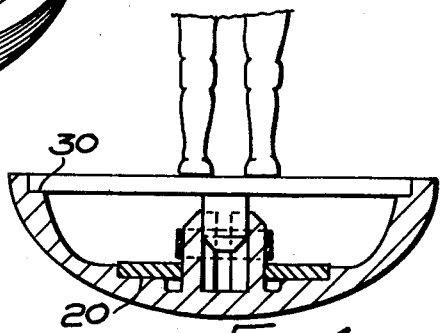
FIG. 4 is a sectional elevation showing the base cup of FIG. 1, the washer of FIG. 2 and the disc of FIG. 3 in assembled condition.

In fitting the disc means 22 to the base cup 10, the chamfered end 26 of spigot element 24 is located in the bore of the socket element 12, and then the disc 22 is simply pushed downwards, frictionally engaging in the socket element 12, until the disc seats on ledge 30 formed internally at the rim of the base cup 10. The spring clip 19 acts to prevent excessive outwards distortion of the segments of socket element 12 and indeed acts to push the segments of socket element 12 into firm frictional engagement with the spigot element and this prevents accidental detachment of the base and disc means. FIG. 4 shows the assembled unit of figure and mounting in sectional elevation, and it will be noticed that the spigot and socket elements are located internally of the mounting.

By springingly holding the socket element 12, the spigot element 24 will become engaged therein with a much greater frictional force than it otherwise would be, were the spring clip 19 to be omitted. As a result, the disc means 22 can only subsequently be removed with great difficulty, and as it is arranged that the disc means 22 should lie in the cup 10 so that its top surface is flush or under the top peripheral rim of the cup 10, then it is not possible to pry the disc means out of the cup using a screwdriver or the like instrument.

Figure 5:
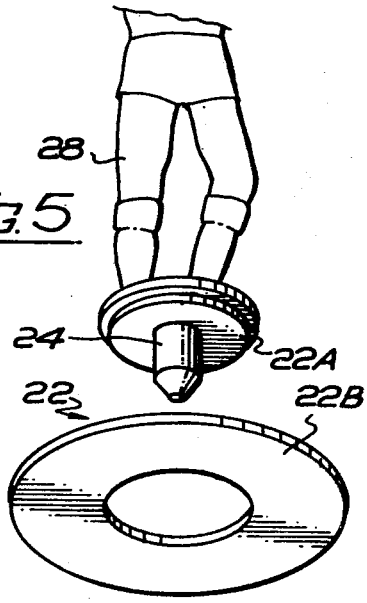
FIG. 5 is a view similar to FIG. 3 showing an alternative disc means and figure arrangement for use with the base cup of FIG. 1.
Figure 6:
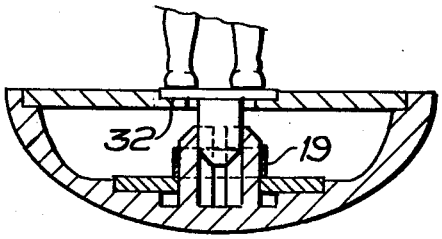
FIG. 6 is a sectional view showing the base cup of FIG. 1, the washer of FIG. 2 and the disc means and figure arrangement of FIG. 5 in assembled condition.

FIGS. 5 and 6 show another embodiment of the disc means and figure arrangement. In the embodiment of FIGS. 5 and 6, the disc means 22 is in two parts, namely a small central part 22A, and an annular peripheral part 22 B. The bore in the part 22B is stepped as shown in FIG. 6 at 32, and the central part 22A is adapted to seat on this ledge 32 in the assembled condition of the mounting, as shown in FIG. 6. The spigot element 24 is provided on the underside of central part 22A, and the figure 28 is formed integrally with and on the upper side of the part 22A. Therefore, in the assembled condition shown in FIG. 6 the frictional grip between spigot element 24 and socket element 12 effects the connection between the center part 22A of the disc 22 and the base cup 10 and as the center part 22A seats on ledge 32, this frictional engagement also ensures the holding in position of the outer annular part 22B of the disc 22. Clip 19 is provided as in the FIG. 4 arrangement, as shown in FIG. 6, for the purpose as described.

Referring now to FIGS. 8 to 10 of the drawings, the base cup 110 shown in FIG. 8 is basically the same as that shown in FIG. 1, except for a few exceptions. The socket element 112 again has axial slots 116 at 90° spaced locations so as to leave four socket element segments which are squared off at the top instead of having chamfer 14 and which can be distorted radially inwards or outwards together so as to narrow or enlarge the bore of the socket element, at least at the top and end thereof. In addition, each socket element segment is provided with an axial location rib 116A for the location of a washer similar to washer 18 shown in FIG. 2.

After locating the washer 18 over the socket element 116, the washer 18 is pushed downwardly until it reaches the seating ledge 120 (FIG. 10) in the bottom of the base cup 110, so that its central aperture engages the ribs 116A.

In order to complete the assembly, the cup 110 is closed by a disc means 122 which is in two parts, namely a small central part 122A, and an annular peripheral part 122B. At the top side thereof, the bore in the part 122B is stepped as shown in FIG. 10 at 132, and the central part 122A is adapted to seat on this ledge 132 in the assembled condition of the mounting, as shown in FIG. 10.

The spigot element 124 is provided on the underside (as shown in FIG. 9) of central part 122A and a figure 128 is formed integrally with and on the upper side of the part 122A similar to the arrangement of FIGS. 5 and 6. On the underside of the peripheral part 122B there is an integral holding sleeve 126, which is adapted to engage the outside of the top of the socket element 112 in the assembled condition. In order to assemble the mounting, the peripheral part 122B is pressed into the position shown in FIG. 10, in which the sleeve 126 engages over the top of socket element 112 in order to hold the tops of the segments of the socket element 112 in position. Next, the central part 122A is pushed into the position shown in FIG. 10, a suitable tool being used if desired. The spigot element 124 firmly and frictionally engages in the socket element 112. The sleeve 126 may either push the tops of the segments of socket element 112 inwardly or may simply prevent the segment tops from moving outwardly as the spigot element 124 engages in the socket, but in any event the sleeve improves the maintenance of the frictional grip between the socket element and spigot element when the mounting is assembled. Therefore, in the assembled condition shown in FIG. 4, the frictional grip between spigot element 124 and socket element 112 effects the connection between the center part 122A of the disc 122 and the base cup 110 and as the center part 122A seats on ledge 132, this frictional engagement also ensures the holding in position of the outer annular part 122B of the disc 122. The holding together of the spigot element 124 and socket element 112 may be assisted by means of adhesive in the socket element 112.

In another embodiment, the figure is not formed integrally with the disc means, but the disc is otherwise adapted to accept a figure. The figure may simply be glued to the disc means, but it is unlikely that this will be considered the best method of mounting the figure, as it may be liable to ready detachment in use.

In the embodiments described the connection between the spigot element and socket element is described as being by frictional engagement. This may be assisted by means of adhesive, or alternatively the spigot element may be a loose fit in the socket element and the connection between socket and spigot element may be by means of adhesive in the socket. Although the socket element in the embodiments is illustrated in the drawings as being a split bushing, it may be a hole formed in the bottom of the cup, where such cup is moulded with a thickened bottom.

The assembled units, for example as shown in FIG. 4, FIG. 6 and FIG. 10 are for use in a table football game, and the method of play involves the flicking of the units over a playing surface. The ballast weight 18, combined with the particular shape of the base cup shown, has the effect of tending to return the unit to the upright position. In other words, the units tend to be self-righting.

With the exception of the metal weight 18, and spring clip 19 it is preferred that of the other components be moulded in plastics material.

I claim:

1. In a figure unit for a game where the figure unit is of the type having a figure disposed on a self righting mounting comprised of a base cup whose top is closed by disc means on which the figure stands, the improvement wherein the disc means is secured to the base cup by a concealed connection within that cup, the concealed connection comprising components extending upwardly from the bottom of the base cup and downwardly from the underside of the disc means, said components comprising a spigot, a socket and a ring, said spigot being engaged in the socket, said socket being axially split into resiliently yielding segments, and said ring surrounding the split socket and limiting the resilient yielding of the segments.

2. In a figure unit for a game wherein the figure unit is of the type having a figure disposed on a self righting mounting comprised of a base cup whose top is closed by disc means on which the figure stands, the improvement wherein the disc means is secured to the base cup by a concealed connection within that cup, the concealed connection comprising components extending upwardly from the bottom of the base cup and downwardly from the underside of the disc means, said components comprising a spigot and a socket, the spigot being engaged in the socket, and the disc means comprising an outer peripheral part and a central part, the central part having the figure on one side and one of said components of the concealed connection on the other side, the socket being axially split into flexible segments that fit round the spigot, and the unit further including a spring clip urging the flexible segments into clamping engagement with the spigot.

3. In a figure unit for a game wherein the figure unit is of the type having a figure disposed on a self righting mounting base cup whose top is closed by disc means on which the figure stands, the improvement wherein the disc means is secured to the base cup by concealed connection within that cup, the concealed connection comprising components extending upwardly from the bottom of the base cup and downwardly from the underside of the disc means, said components comprising a spigot, a socket and a sleeve, the spigot being engaged in the socket and the socket being axially split into flexible segments that fit around the spigot, and the sleeve fitting round the socket and causing the flexible segments to tightly engage the spigot.

4. The improved figure unit according to claim 3, wherein the disc means has a central part carrying the figure and the spigot and has a separate outer peripheral part carrying the sleeve.

* * * * *